US007285076B2

(12) United States Patent
Kelly

(10) Patent No.: US 7,285,076 B2
(45) Date of Patent: Oct. 23, 2007

(54) OSCILLATING EXERCISE MACHINE

(76) Inventor: Gerry K. Kelly, Box 304, Charlie Lake, BC (CA) V0V 1H0

( * ) Notice: Subject to any disclaimer, the term of this patent is extended or adjusted under 35 U.S.C. 154(b) by 0 days.

(21) Appl. No.: 11/302,340

(22) Filed: Dec. 14, 2005

(65) Prior Publication Data

US 2007/0135270 A1 Jun. 14, 2007

(51) Int. Cl.
*A63B 69/16* (2006.01)
*A63B 21/008* (2006.01)

(52) U.S. Cl. ..... 482/57; 482/112; 482/113

(58) Field of Classification Search ..... 482/51–54, 482/57–59, 111–113, 510
See application file for complete search history.

(56) References Cited

U.S. PATENT DOCUMENTS

| | | | | | |
|---|---|---|---|---|---|
| 2,419,998 | A * | 5/1947 | Johnson | 601/36 |
| 3,134,378 | A | 5/1964 | Harwood | |
| 3,513,928 | A | 5/1970 | Emmons | |
| 3,727,913 | A | 4/1973 | Glaser | |
| 3,940,128 | A | 2/1976 | Ragone | |
| 4,479,646 | A | 10/1984 | Beistegui Chirapozu | |
| 4,586,706 | A * | 5/1986 | Chen | 482/62 |
| 5,016,872 | A * | 5/1991 | Lee | 482/58 |
| 5,033,736 | A | 7/1991 | Hirschfeld | |
| 5,035,418 | A * | 7/1991 | Harabayashi | 482/62 |
| 5,058,887 | A * | 10/1991 | Patterson | 482/113 |
| 5,145,477 | A * | 9/1992 | Han | 482/57 |
| 5,240,417 | A | 8/1993 | Smithson et al. | |
| 5,342,262 | A | 8/1994 | Hansen | |
| 5,410,472 | A | 4/1995 | Anderson | |
| 5,549,527 | A * | 8/1996 | Yu | 482/57 |
| 5,931,765 | A * | 8/1999 | Huang | 482/57 |
| 6,027,432 | A | 2/2000 | Cheng | |
| 6,419,613 | B2 * | 7/2002 | Stearns et al. | 482/57 |
| 6,488,640 | B2 | 12/2002 | Hood, Jr. et al. | |
| 6,648,802 | B2 | 11/2003 | Ware | |
| 6,793,609 | B1 * | 9/2004 | Fan | 482/57 |
| 7,008,352 | B2 * | 3/2006 | Grossi | 482/54 |
| 2005/0079964 | A1 | 4/2005 | Francavilla | |

FOREIGN PATENT DOCUMENTS

| | | |
|---|---|---|
| WO | WO2005/046806 A2 | 5/2005 |

* cited by examiner

*Primary Examiner*—Stephen R. Crow
*Assistant Examiner*—Tam Nguyen
(74) *Attorney, Agent, or Firm*—Clark Wilson LLP; Michael J. Roman

(57) ABSTRACT

The present invention relates to a low-impact, time-efficient way to exercise both the cardio-respiratory system and the muscular system, particularly the abdominal and back muscles. The exerciser uses his muscles to oscillate a pivoted carriage within a frame. In one embodiment, the exerciser pedals a crank to pump hydraulic fluid through a hydraulic circuit to a hydraulic cylinder connected between the carriage and the frame so as to urge the carriage to oscillate with respect to the frame. A limit sensor detects when the carriage is positioned at one extreme of its oscillation and signals the hydraulic circuit to reverse the flow of hydraulic fluid to the hydraulic cylinder.

21 Claims, 9 Drawing Sheets

OSCILLATING EXERCISE MACHINE

BACKGROUND OF THE INVENTION

1. Field of the Invention

The present invention relates to exercise equipment, and more specifically to exercise machines that simultaneously exercise the body's cardio-respiratory system and muscular system, particularly the abdominal and back muscles.

2. Description of Related Art

It is well known that proper exercise can enhance the length and quality of a person's life. Nevertheless, many people don't exercise properly.

One reason many people exercise less than they should is that they cannot find the time for a proper workout. Thus, they may exercise sporadically and achieve poor results or else they may not exercise at all. Alternatively some people may exercise too intensively and hurt themselves, for example in high-impact aerobics classes, which might also lead to not exercising at all, at least while their injuries are mending.

Although it is beneficial for a person to exercise both his cardio-respiratory system and muscular system, it is challenging to identify a single exercise or exercise machine that is sufficient, or at least effective, for this purpose. More commonly, a person will have to perform a series of exercises on a series of exercise machines in order to exercise various muscle systems and the cardio-respiratory system.

However, many people don't have the time, inclination or aptitude to learn how to perform a series of exercises or to learn how to properly operate a series of exercise machines, each such exercise or machine focusing on a different aspect of cardio-respiratory or muscular health. Even with easy access to a set of exercise machines or even a single reconfigurable combination machine, many people will lose determination in the face of such complication. In this regard, simple, general-purpose machines such as stationary bicycles and treadmills are more likely to be used, even though the exercise they provide may be less than optimal, leaving important muscle systems unexercised or minimally exercised.

The abdominal and back muscles are particularly challenging to isolate for proper exercise. Because poor health in these muscles can lead to disabling back pain, it is important to exercise them regularly. However, improper exercise of these muscles, particularly by people with pre-existing injuries, can cause serious damage.

Accordingly, what is needed is a low-impact, time-efficient way to exercise both the cardio-respiratory system and the muscular system, particularly the abdominal and back muscles.

SUMMARY OF THE INVENTION

The present invention is directed to this need.

Essentially, the invention provides a way for a person to exercise some of his muscles to move a carriage while gently exercising some of his other muscles to maintain his balance in the carriage, all the while exercising his cardio-respiratory system. For example, in one embodiment, the person might pedal a crank to pump hydraulic fluid through a hydraulic cylinder connected between the carriage and a frame so as to urge the carriage to oscillate with respect to the frame. The low-impact pedaling provides cardio-respiratory exercise and at the same time exercises his leg muscles. Beneficially, his abdominal and back muscles are gently but effectively exercised as he continuously adjusts his balance in the oscillating carriage.

According to one aspect of the present invention, there is provided an exercise apparatus having a frame; a carriage pivotally coupled to the frame for oscillatory motion relative thereto; and a motor adapted to receive at least some of its required input energy in the form of human motion, connected to the frame and the carriage so as to urge the carriage to oscillate relative to the frame.

The motor might include an input transducer for receiving energy in the form of human motion, for example a lever or a crank in which the lever is a crank-arm, perhaps having a pedal.

The motor might include an actuator connected to the frame and the carriage so as to urge the carriage to oscillate relative to the frame. The actuator could include a cylinder having a piston, perhaps a double-acting cylinder, having an extension port and a retraction port whereby hydraulic fluid supplied to the extension port urges the piston to extend from the cylinder and hydraulic fluid supplied to the retraction port urges the piston to retract into the cylinder.

The motor might include a hydraulic pump connected to the input transducer to receive at least some of its required input energy and connected to the cylinder to exchange hydraulic fluid.

The motor might include a hydraulic circuit that connects the hydraulic pump to the extension port and the retraction port, the hydraulic circuit having a first state in which the pump draws hydraulic fluid from the retraction port and supplies hydraulic fluid to the extension port, such that the piston is urged to extend from the cylinder and a second state in which the pump draws hydraulic fluid from the extension port and supplies hydraulic fluid to the retraction port, such that the piston is urged to retract into the cylinder. The hydraulic circuit might provide mechanical advantage between the input transducer and the actuator.

The motor might include a limit sensor that generates a signal when the carriage is positioned at one extreme of its oscillation relative to the frame and the hydraulic circuit might change its state in response to the signal.

The carriage might include at least one of: a harness to secure a person; a seat; a platform to support a person; and a handlebar.

Further aspects and advantages of the present invention will become apparent upon considering the following drawings, description, and claims.

DESCRIPTION OF THE INVENTION

The invention will be more fully illustrated by the following detailed description of non-limiting specific embodiments in conjunction with the accompanying drawing figures. In the figures, similar components and/or features may have the same reference label.

DETAILED DESCRIPTION OF SPECIFIC EMBODIMENTS

(a) Structure of Specific Embodiments

Figure 1:
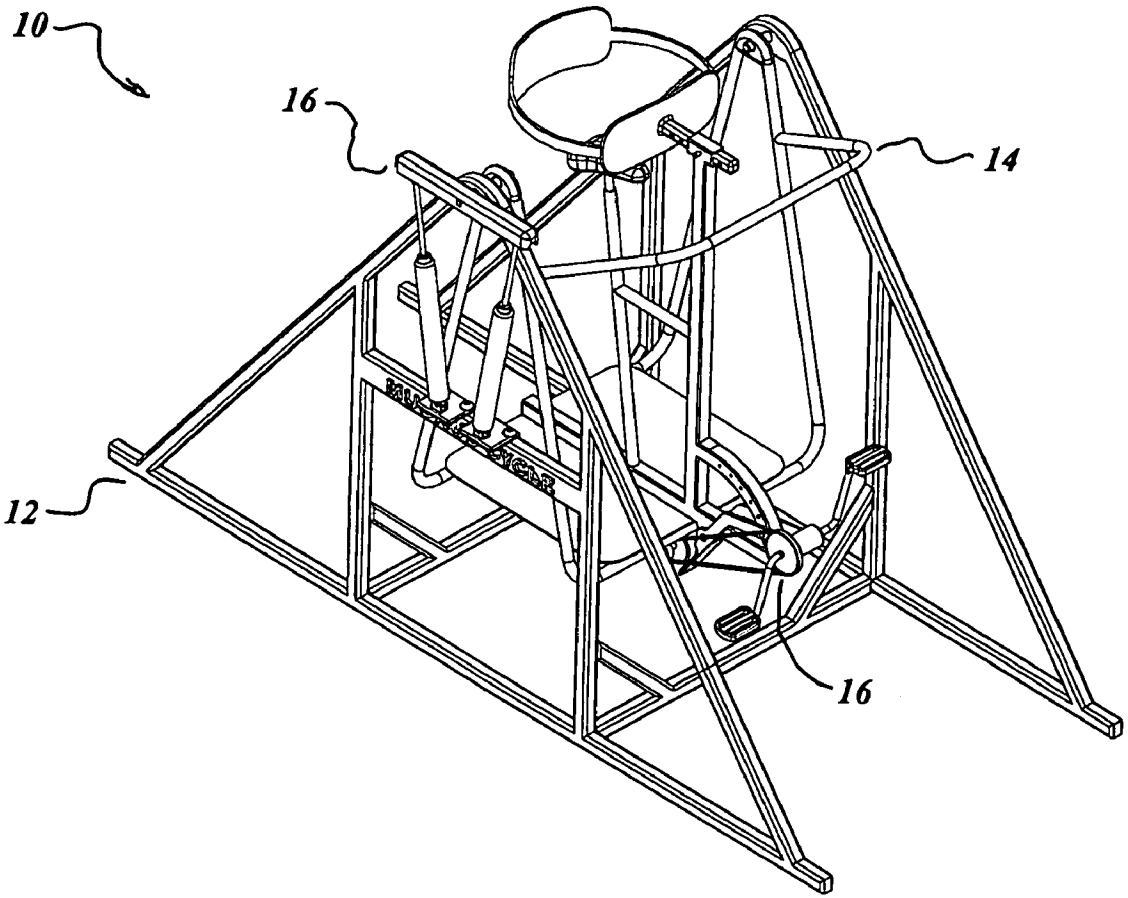
FIG. 1 is an isometric view of an exercise machine according to one embodiment of the present invention, the exercise machine having a frame, a carriage and a motor.

The structure of the invention will now be illustrated by way of explanation of non-limiting specific exemplary embodiments shown in the drawing figures and described in greater detail herein.

FIG. 1 shows an exercise machine according to a first embodiment of the present invention, generally illustrated at 10. The exercise machine 10 includes a frame 12, a carriage 14 pivotally attached to the frame 12 for relative oscillatory movement, and a motor 16 connected between the frame 12 and the carriage 14 so as to urge the carriage 14 to oscillate relative to the frame 12. The motor 16 is constructed to receive at least some of its required input energy in the form of human motion, as will be further described below. As used herein, the word "motor" is defined broadly as: something that imparts motion; a source of power, kinetic energy or force.

Those skilled in the art will appreciate that the frame 12 and the carriage 14 might be pivoted for different oscillatory movement than that illustrated, for example oscillation about a different axis of symmetry, such as rolling or yawing instead of or in addition to the pitching described in this embodiment. For that matter, a pivot axis need not be an axis of symmetry, should a bias be desired for example.

Figure 2:
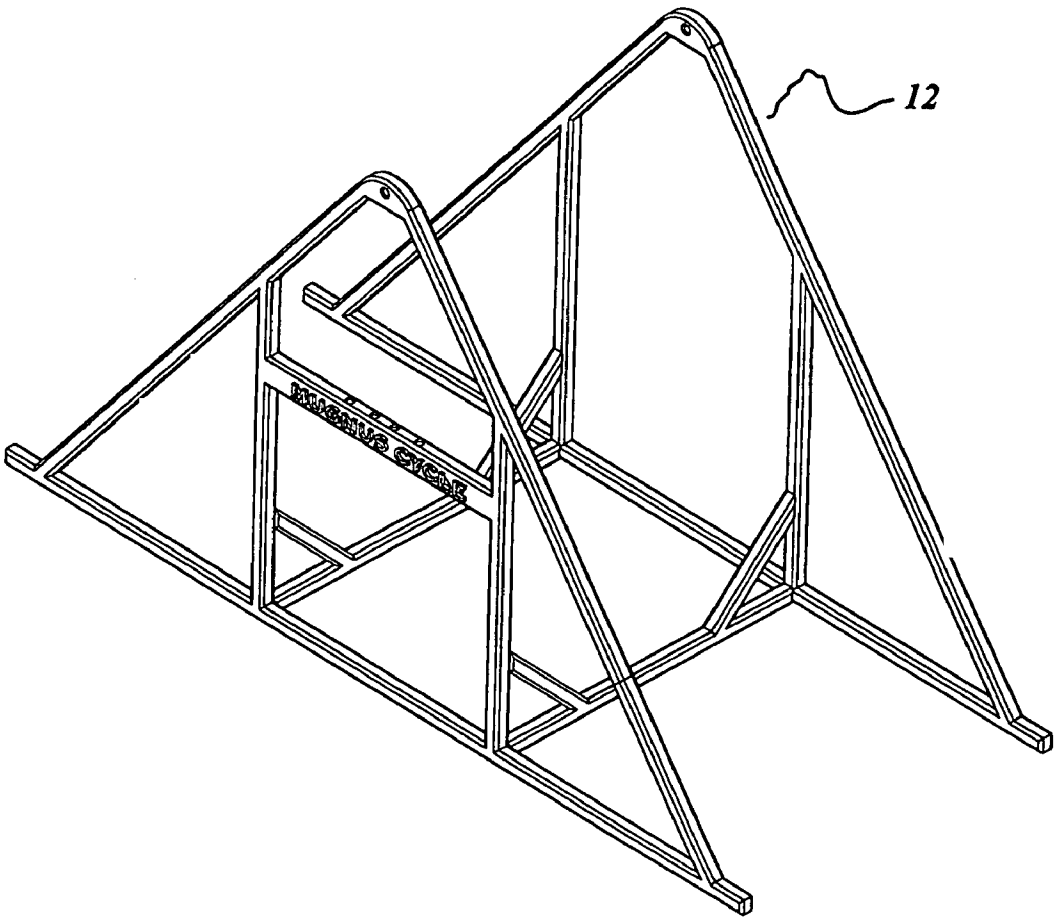
FIG. 2 is an isometric view of the frame of the exercise machine of FIG. 1.

FIG. 2 illustrates the frame 12 in isolation for greater clarity. Desirably, the frame 12 is robust and stable, with a large enough base to support the oscillating mass of the carriage 14 and an exerciser. In this embodiment, the frame 12 is formed from steel square tubing that is crossbraced and welded together. Many other materials, constructions and configurations would also be suitable, without departing from the teaching of the invention, so long as the frame 12 supports oscillation of the carriage 14, either directly or indirectly.

Figure 3:
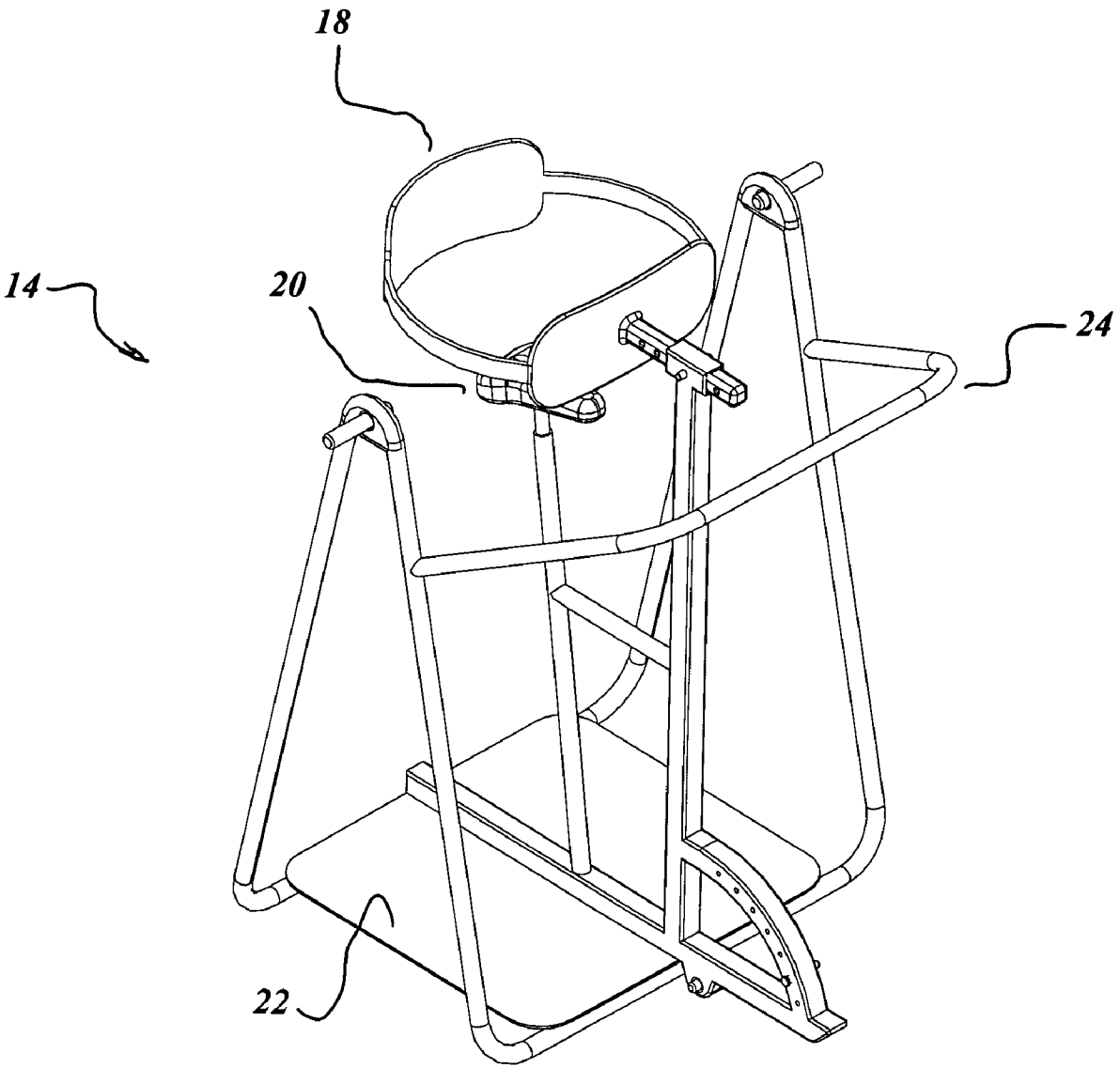
FIG. 3 is an isometric view of the carriage of the exercise machine of FIG. 1.
Figure 4:
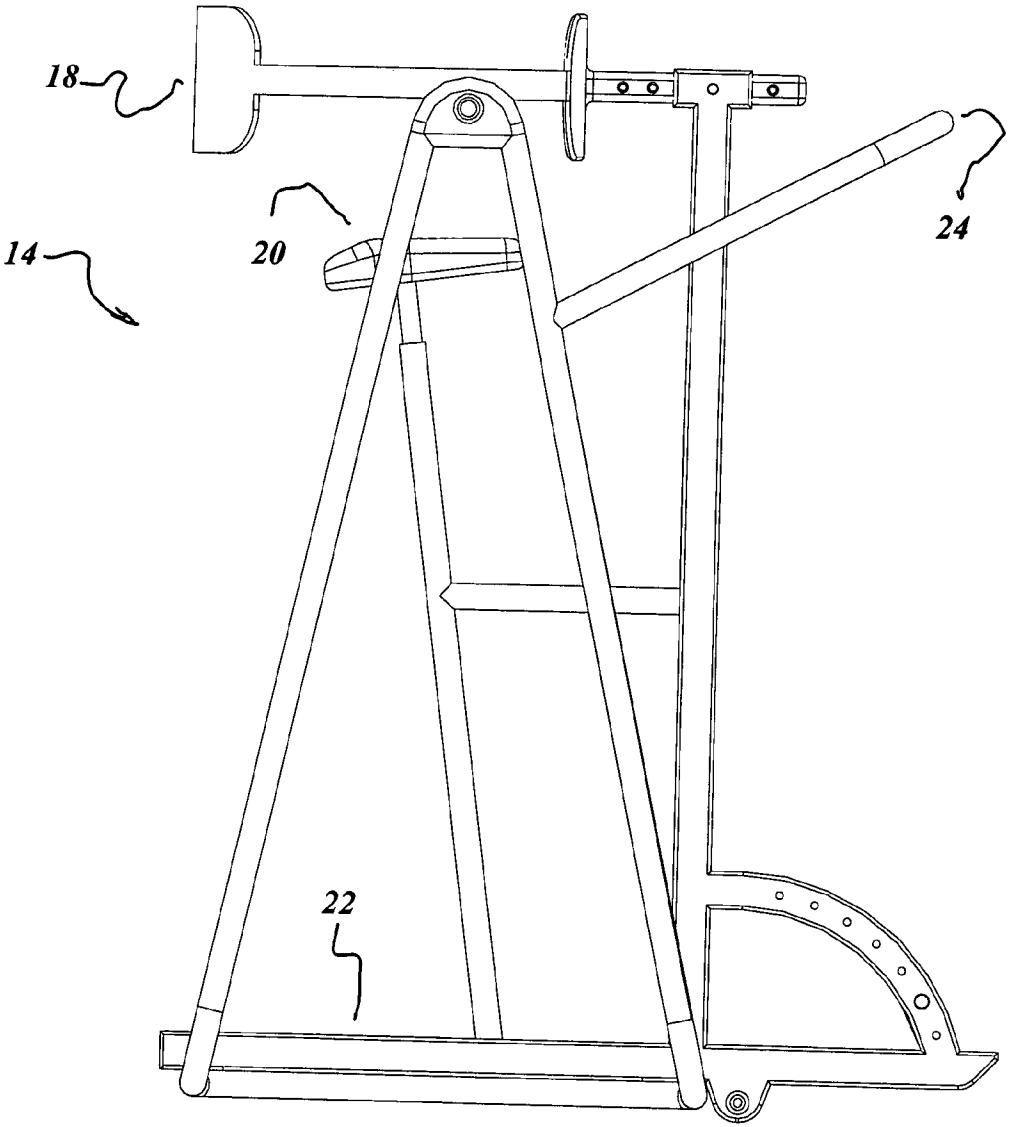
FIG. 4 is a side view of the carriage of FIG. 3.

FIGS. 3 and 4 illustrate the carriage 14 in isolation for greater clarity. The carriage 14 has a number of parts that help to position and retain the exerciser throughout the oscillatory trajectory of the carriage 14, including a harness 18 to secure the exerciser, a seat 20, a platform 22 to support the exerciser, and a handlebar 24. Desirably, the carriage 14 is robust and stable, and in this embodiment has a center of gravity below the pivot. In this embodiment, the carriage 14 is formed from steel square tubing that is crossbraced and welded together. Many other materials, constructions and configurations would also be suitable, without departing from the teaching of the invention.

Figure 5:
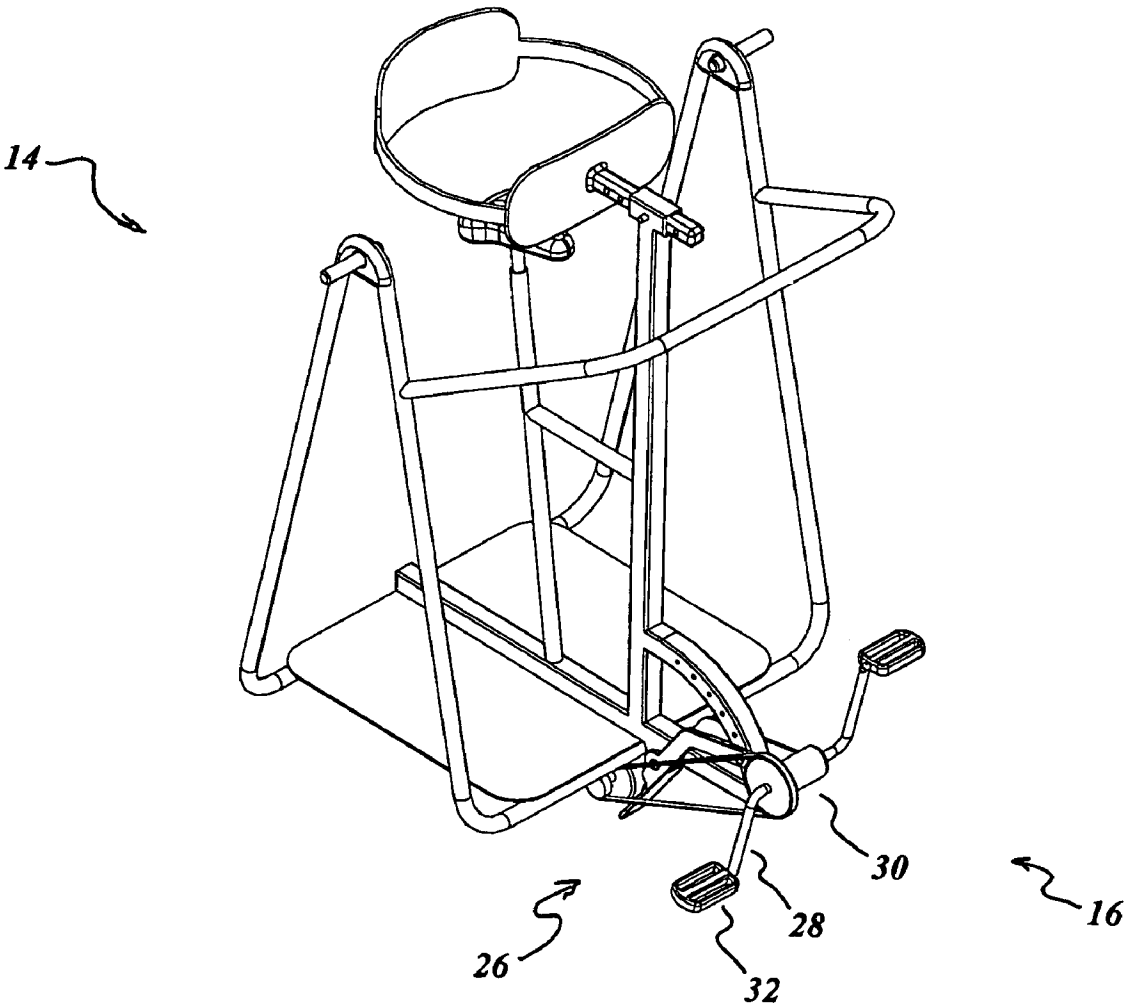
FIG. 5 is an isometric view of carriage of FIG. 3 and a portion of the motor.
Figure 6:
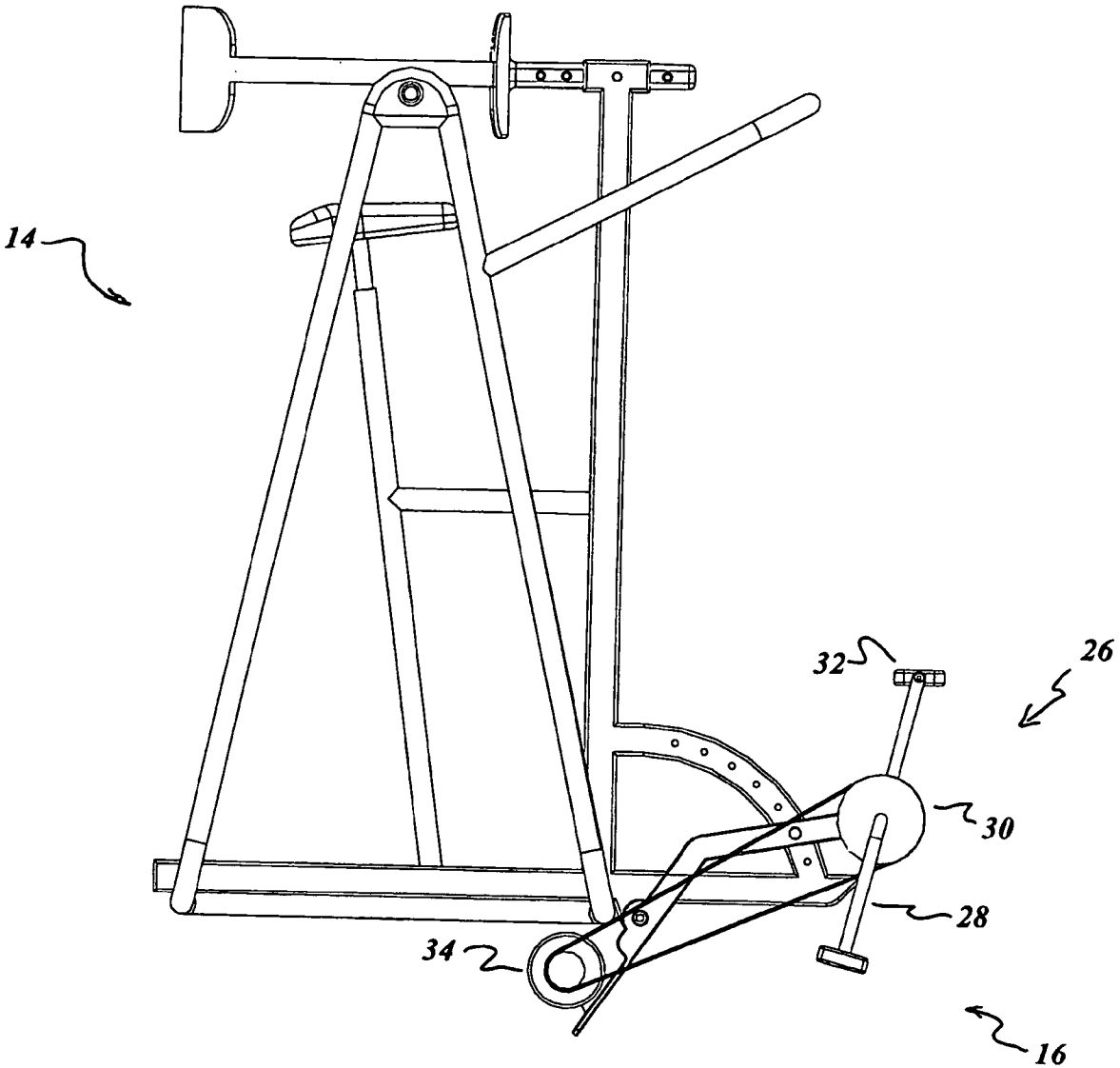
FIG. 6 is a side view of the carriage of FIG. 3 and a portion of the motor.

FIGS. 5 and 6 illustrate the carriage 14 in combination with a portion of the motor 16. The motor 16 includes an input transducer 26 for receiving energy in the form of human motion, for example the movement of an exerciser's body part such as a leg or an arm or the movement or weight-shift of the exercisers body as a whole. In this embodiment, the input transducer 26 includes a lever 28, which more specifically is a crank-arm of a crank 30 and has a pedal 32.

As best seen in FIG. 6, the motor 16 further includes a hydraulic pump 34 connected to the input transducer 26 to receive at least some of its required input energy. The input transducer 26 might be mechanically coupled to the pump 34 (as illustrated) or might be otherwise coupled, for example electrically coupled through a motor-generator set (not illustrated). The pump 34 might also receive some of its required input energy for example from electrical power mains (not illustrated), a battery (not illustrated), a generator (not illustrated), or a source of potential energy, such as a spring (not illustrated).

Figure 7:
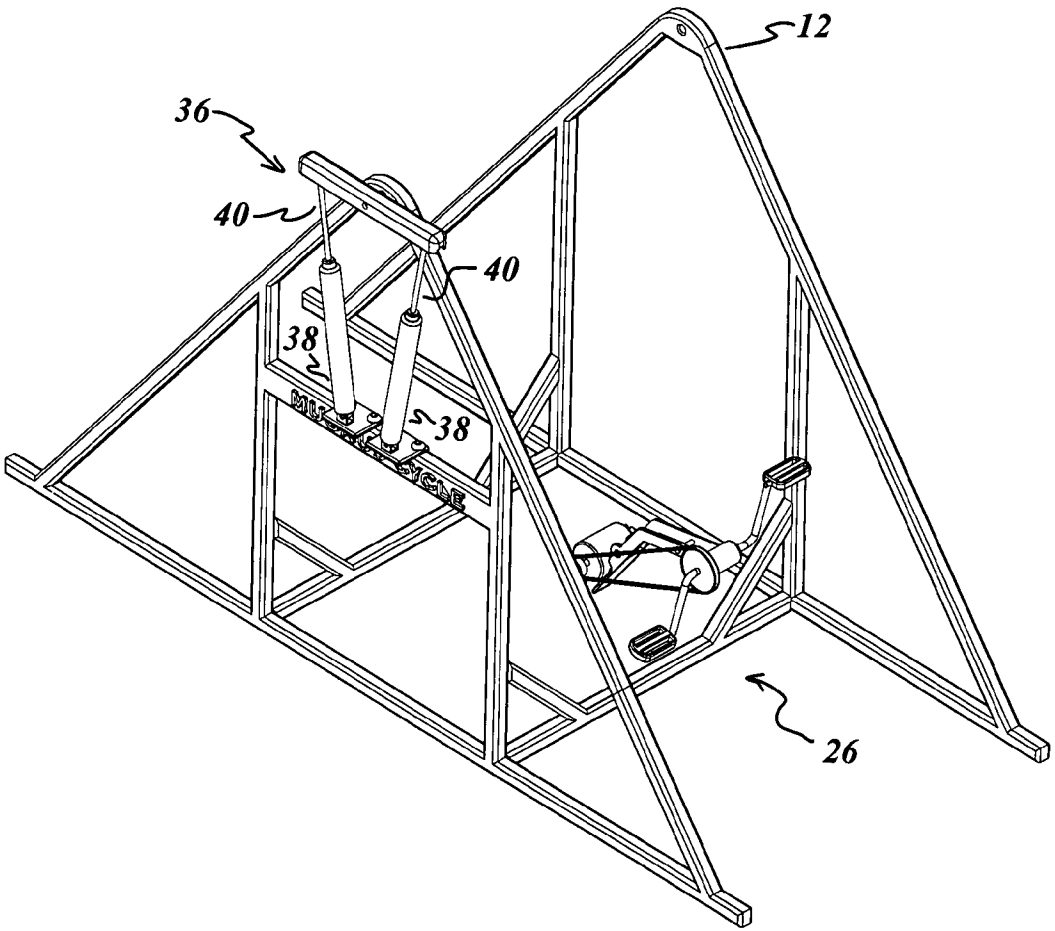
FIG. 7 is an isometric view of the frame of FIG. 2 and a portion of the motor.
Figure 8:
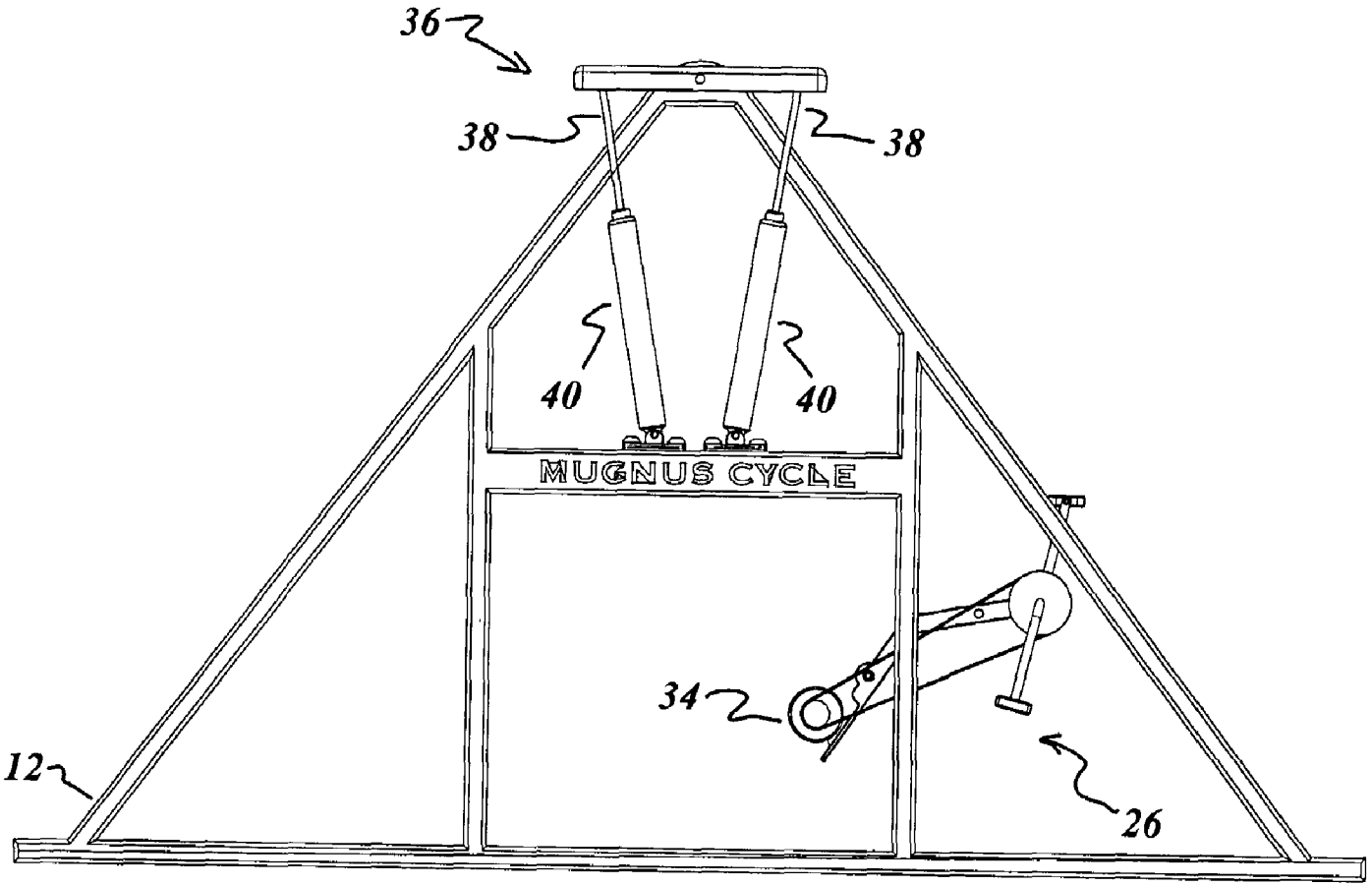
FIG. 8 is a side view of the frame of FIG. 2 and a portion of the motor.

FIGS. 7 and 8 illustrate the frame 12 in combination with a portion of the motor 16. The motor 16 further includes an actuator 36 connected to the frame 12 and the carriage 14 so as to urge the carriage 14 to oscillate relative to the frame 12. In this embodiment, the actuator includes at least one cylinder 38 (having a piston 40), to which the pump 34 is connected to exchange hydraulic fluid.

Figure 9:
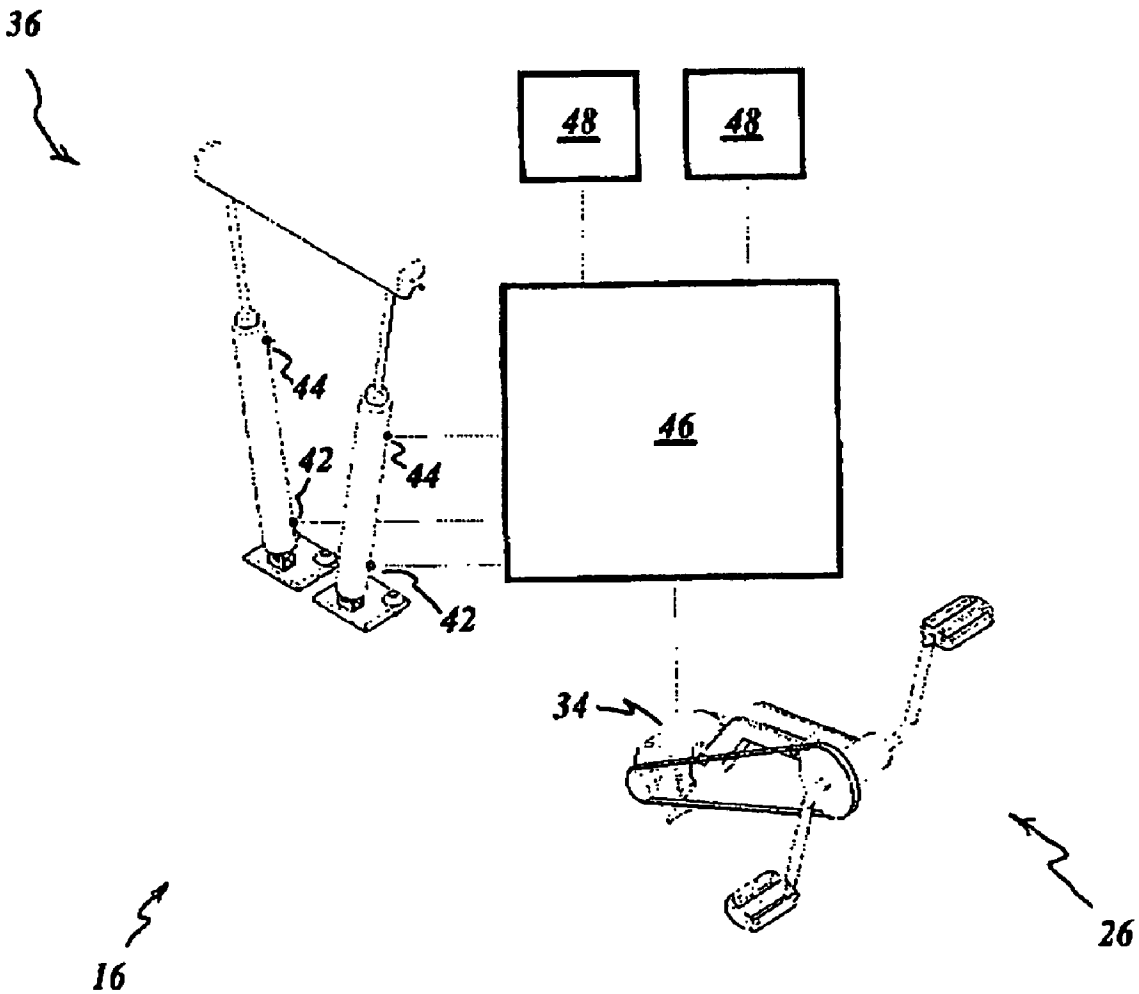
FIG. 9 is an isometric and schematic view of the motor of the exercise machine of FIG. 1.

FIG. 9 illustrates the complete motor 16 in greater detail. The cylinder 38 is double-acting, having an extension port 42 and a retraction port 44, such that hydraulic fluid supplied to the extension port 42 or drawn from the retraction port 44 urges the piston 40 to extend from the cylinder 38 whereas hydraulic fluid supplied to the retraction port 44 or drawn from the extension port 42 urges the piston 40 to retract into the cylinder 38.

The motor 16 includes a hydraulic circuit 46 that connects the pump 34 to the extension port 42 and the retraction port 44. The circuit 46 has a first state in which the pump 34 draws hydraulic fluid from the retraction port 44 and supplies hydraulic fluid to the extension port 42 (thus urging the piston 40 to extend from the cylinder 38) and a second state in which the pump 34 draws hydraulic fluid from the extension port 42 and supplies hydraulic fluid to the retraction port 44 (thus urging the piston 40 to retract into the cylinder 38). The circuit 46 can be configured to provide mechanical advantage between the input transducer 26 and the actuator 36. The circuit 46, pump 34 and actuator 36 could operate on compressed gas, instead of hydraulic fluid.

The motor 16 further includes first and second limit sensors 48, which generate a signal when the carriage 14 is positioned at a respective extreme of its oscillation relative to the frame 12. The circuit 46 is configured to change its state in response to this signal.

(b) Operation of Specific Embodiments

With reference now to the figures, the operation of these specific embodiments of the invention will now be described.

To prepare for his exercise routine, an exerciser steps into the carriage (best seen in FIGS. 3 through 6) and secures himself using a combination of the harness 18, the seat 20, the platform 22, and the handlebar 24.

To begin his exercise routine, the exerciser begins pedaling the crank 30 to operate the pump 34. The pump 34 pumps hydraulic fluid through the circuit 46, which in its current state causes the piston 40 to move relative to the cylinder 38, thereby urging the carriage 14 to pivot relative to the frame 12.

As the exerciser continues to pedal the crank 30, the piston 40 and the carriage 14 continue to so move until one of the limit sensors 48 detects that the carriage 14 is positioned at an extreme of its oscillation relative to the frame 12 and generates a signal. In response to the signal, the circuit 46 changes its state and reverses the direction hydraulic fluid flows through the cylinder 38, which causes the piston 40 to move oppositely relative to the cylinder 38, thereby urging the carriage 14 to pivot oppositely relative to the frame 12, in an oscillatory motion.

The circuit 46 might be configured to handle in various ways an absence or reduction of pedaling the crank 30 and the consequent cessation or reduction of the volume of hydraulic fluid being pumped by the pump 34. For example, the circuit 46 might be configured to maintain the piston 40 in its current position with respect to the cylinder 38, thereby holding the carriage 14 in place until sufficiently active pedaling recommences. Or the circuit 46 might be configured to allow the piston 40 to slowly return to its rest position in the cylinder 38, such that the carriage 14 safely returns to its equilibrium position in the frame 12, much more slowly than free-fall.

(c) Description Summary

Thus, it will be seen from the foregoing embodiments and examples that there has been described a low-impact, time-efficient way to exercise both the cardio-respiratory system and the muscular system, particularly the abdominal and back muscles.

While specific embodiments of the invention have been described and illustrated, such embodiments should be considered illustrative of the invention only and not as limiting the invention as construed in accordance with the accompanying claims.

It will be understood by those skilled in the art that various changes, modifications and substitutions can be made to the foregoing embodiments without departing from the principle and scope of the invention expressed in the claims made herein. For example, other linkages between the input transducer 26 and the actuator 36 could be made. The actuator 36 might be an electric motor, in which case the pump 34 might be replaced by a motor-generator set and the hydraulic circuit 46 by an electric one. Alternatively, the actuator 36 might be a gear drive, in which case the pump 34 and the circuit 46 might be replace by a gearbox or transmission, including a simple chain.

While the invention has been described as having particular application for exercise, those skilled in the art will recognize it has wider application, for example for physiotherapy.

What is claimed is:

1. An exercise apparatus comprising:

a) a frame having a pivot axle;

b) a carriage, suspended from the pivot axle for oscillatory motion relative thereto; and c) a motor, adapted to receive at least some of its required input energy in the form of human motion, connected to the frame and the carriage so as to urge the carriage to move relative to the frame, wherein the motor includes:

i) an input transducer for receiving energy in the form of human motion;

ii) an actuator having a pair of hydraulic cylinders each with a piston and each connected to the frame and carriage, via a fulcrum with one cylinder being disposed on each opposite side of the pivot axle, so as to urge the carriage to move relative to the frame wherein each cylinder is double acting having an extension port and a retraction port; and iii) a hydraulic pump connected to the input transducer, to receive at least some of its required input energy therefrom, and the cylinders to exchange hydraulic fluid therewith whereby hydraulic fluid supplied to the extension port urges the piston to extend from the cylinder and hydraulic fluid supplied to the retraction port urges the piston to retract into the cylinder.

2. An apparatus as claimed in claim 1, wherein the motor includes a hydraulic circuit that connects the hydraulic pump to the extension port and the retraction port, the hydraulic circuit having:

(a) a first state in which the pump draws hydraulic fluid from the retraction port and supplies hydraulic fluid to the extension port, whereby the piston is urged to extend from the cylinder; and (b) a second state in which the pump draws hydraulic fluid from the extension port and supplies hydraulic fluid to the retraction port, whereby the piston is urged to retract into the cylinder.

3. An apparatus as claimed in claim 2, wherein:

(a) the motor includes a limit sensor operable to generate a signal when the carriage is positioned at one extreme of its oscillation relative to the frame; and (b) the hydraulic circuit is operable to change its state in response to the signal.

4. An apparatus as claimed in claim 3, wherein the hydraulic circuit provides mechanical advantage between the input transducer and the actuator.

5. An apparatus as claimed in claim 4, wherein the hydraulic circuit maintains the piston in its current position with respect to the cylinder when the motor stops receiving input energy in the form of human motion.

6. An apparatus as claimed in claim 4, wherein the hydraulic circuit allows the piston to slowly return to a rest position in the cylinder when the motor stops receiving input energy in the form of human motion.

7. An apparatus as claimed in claim 4, wherein the carriage includes at least one of:

(a) a harness adapted to secure a person;

(b) a seat;

(c) a platform adapted to support a person; and (d) a handlebar.

8. An exercise apparatus comprising:

a) a frame having a point of suspension;

b) a carriage, suspended from the frame at the point of suspension for oscillatory motion relative to the frame, whereby substantially all of the carriage rests below the point of suspension; and c) a motor, adapted to receive at least some of its required input energy in the form of human motion, connected to the frame and the carriage so as to urge the carriage to move relative to the frame, wherein the motor includes:

i) an input transducer for receiving input energy in the form of human motion; and ii) a hydraulic actuator having a pair of cylinders each with a piston and each connected to the frame and carriage, via a fulcrum with one cylinder being disposed on each opposite side of the pivot axle, so as to urge the carriage to move relative to the frame.

9. An apparatus as claimed in claim 8, wherein the motor includes a hydraulic pump connected to the input transducer to receive at least some of its required input energy therefrom and the hydraulic actuator to exchange hydraulic fluid therewith.

10. An apparatus as claimed in claim 9, wherein the motor includes a hydraulic circuit that connects the pump to the actuator, the circuit having:

(a) a first state in which hydraulic fluid from the pump is urged through the actuator in a first way, whereby the actuator urges the carriage to move along a path with respect to the frame in a first direction; and (b) a second state in which hydraulic fluid from the pump is urged through the actuator in a second way, whereby the actuator urges the carriage to move along the path in a second direction, opposite the first direction.

11. An apparatus as claimed in claim 10, wherein:

(a) the motor includes a limit sensor operable to generate a signal when the carriage is positioned at one extreme of its path relative to the frame; and (b) the circuit is operable to change its state in response to the signal.

12. An apparatus as claimed in claim 10, wherein the circuit provides mechanical advantage between the input transducer and the actuator.

13. An apparatus as claimed in claim 10, wherein the circuit maintains the actuator in its current position when the motor stops receiving input energy in the form of human motion.

14. An apparatus as claimed in claim 10, wherein the circuit allows the actuator to slowly return to a rest position when the motor stops receiving input energy in the form of human motion, whereby the carriage slowly returns to an equilibrium position with respect to the frame.

15. An exercise apparatus comprising:

a) a frame having a point of suspension;

b) a carriage, suspended from the frame at the point of suspension for oscillatory motion relative to the frame, whereby the center of gravity of the occupied carriage is below the point of suspension; and c) a motor, adapted to receive at least some of its required input energy in the form of human motion, connected to the frame and the carriage so as to urge the carriage to move relative to the frame, wherein the motor includes:

i) an input transducer for receiving input energy in the form of human motion; and ii) a hydraulic actuator having a pair of cylinders each with a piston and each connected to the frame and carriage, via a fulcrum, with one cylinder being disposed on each opposite side of the pivot axle, so as to urge the carriage to move relative to the frame.

16. An apparatus as claimed in claim 15, wherein the motor includes a hydraulic pump connected to the input transducer to receive at least some of its required input energy therefrom and the hydraulic actuator to exchange hydraulic fluid therewith.

17. An apparatus as claimed in claim 16, wherein the motor includes a hydraulic circuit that connects the pump to the actuator, the circuit having:

(a) a first state in which hydraulic fluid from the pump is urged through the actuator in a first way, whereby the actuator urges the carriage to move along a path with respect to the frame in a first direction; and (b) a second state in which hydraulic fluid from the pump is urged through the actuator in a second way, whereby the actuator urges the carriage to move along the path in a second direction, opposite the first direction.

18. An apparatus as claimed in claim 17, wherein:

(a) the motor includes a limit sensor operable to generate a signal when the carriage is positioned at one extreme of its path relative to the frame; and (b) the circuit is operable to change its state in response to the signal.

19. An apparatus as claimed in claim 17, wherein the circuit provides mechanical advantage between the input transducer and the actuator.

20. An apparatus as claimed in claim 17, wherein the circuit maintains the actuator in its current position when the motor stops receiving input energy in the form of human motion.

21. An apparatus as claimed in claim 17, wherein the circuit allows the actuator to slowly return to a rest position when the motor stops receiving input energy in the form of human motion, whereby the carriage slowly returns to an equilibrium position with respect to the frame.

* * * * *